United States Patent [19]

Sabol

[11] 3,959,164

[45] May 25, 1976

[54] METHOD OF PREPARING OVERBASED BARIUM SULFONATES

[75] Inventor: Albert R. Sabol, Munster, Ind.

[73] Assignee: Standard Oil Company, Chicago, Ill.

[22] Filed: Dec. 20, 1972

[21] Appl. No.: 316,879

[52] U.S. Cl. ..... 252/33; 252/18; 252/25; 252/334

[51] Int. Cl.[2] ..... C10M 1/40

[58] Field of Search ..... 252/18, 25, 33, 33.4

[56] References Cited

UNITED STATES PATENTS

| | | | |
|---|---|---|---|
| 2,727,861 | 12/1955 | Brown et al. | 252/33 |
| 3,704,105 | 11/1972 | Perilstein | 252/33 X |

FOREIGN PATENTS OR APPLICATIONS

| | | | |
|---|---|---|---|
| 209,175 | 11/1956 | Australia | 252/33 |
| 1,444,550 | 1/1969 | Germany | 252/33 |

*Primary Examiner*—Delbert E. Gantz
*Assistant Examiner*—Andrew H. Metz
*Attorney, Agent, or Firm*—Edwin C. Lehner; Arthur G. Gilkes; William T. McClain

[57] ABSTRACT

Over-based oil-soluble barium alkenyl sulfonates wherein the alkenyl moiety is a propene or butene polymer having a number average molecular weight of about 250–500 are obtained by heating a mixture of ammonium alkenyl sulfonates, a precarbonated mixture of barium oxide in methanol, barium oxide and water in the range of about 160–190°F for time sufficient to convert the ammonium sulfonate to barium sulfonate.

3 Claims, No Drawings

METHOD OF PREPARING OVERBASED BARIUM SULFONATES

FIELD OF THE INVENTION

This invention relates to over-based oil-soluble barium alkenyl sulfonates wherein the alkenyl moiety is a propene or butene polymer having a number average molecular weight of about 250-500 and to the preparation thereof.

SUMMARY OF THE INVENTION

A simplified process for preparing over-based oil-soluble barium alkenyl sulfonates, wherein the alkenyl moiety is a propene or butene polymer having a number average molecular weight of about 250–500, has been discovered. In accordance with the invention, the process for preparing over-based oil-soluble barium alkenyl sulfonates comprises: heating a mixture comprising (a) ammonium alkenyl sulfonate wherein the alkenyl moiety is a propene or butene polymer having a number average molecular weight of about 250–500, (b) an amount of an anhydrous precarbonated mixture of barium oxide in methanol sufficient to provide about 1–6 mols of barium per mol of said sulfonate, (c) a stoichiometric amount of barium oxide to convert said sulfonate to barium sulfonate, and (d) about 0.5–1.5 mols water per mol of barium in the mixture at a temperature of about 160°–190°F for a period of time sufficient to convert said ammonium sulfonate to barium sulfonate; and removing methanol, water and unreacted material from the mixture whereby said over-based barium alkenyl sulfonates are obtained.

The desired amount of over-basing material, which is finely-divided barium carbonate, is obtained by first carbonating an anhydrous mixture of barium oxide and methanol and then mixing the carbonated mixture with the sulfonate. The mixture may contain only the amount of barium that is in excess of the stoichiometric amount required to form the barium sulfonate or it may contain an amount of barium sufficient for both the neutralization and over-basing requirements in which case the mixture would be only partially carbonated so as to furnish the neutralization requirement.

The amount of ammonium alkenyl sulfonate in the mixture will be sufficient to provide about 15–30% sulfonate in the product.

The addition of water to the mixture is preferably in incremental portions so as to avoid excessive foaming of the mixture. After all of the water is added, the mixture is held at the indicated temperature until a drop in mixture temperature is noted. The drop in temperature indicates completion of the conversion of the ammonium sulfonate to barium sulfonate. Depending upon the temperature, the heating time will be about 5 to 30 minutes to effect the conversion.

At the end of the heating period, the desired over-based product is obtained simply by removing the methanol, water and any unreacted materials from the mixture.

The use of an inert solvent or diluent in the mixture is optional. However, since a liquid carrier for the product is usually used, a non-volatile hydrocarbon such as a low viscosity mineral oil of a light petroleum fraction such as light catalytic cycle oil is included in the mixture as a processing aid.

The ammonium alkenyl sulfonates described herein are unique oil-soluble materials which are substantially free of hydroxy alkyl sulfonates and are useful as lubricant and fuel additives. It has been found that they can be used as the source of the barium sulfonate in the over-based products of this invention. The oil-soluble ammonium alkenyl sulfonates are derived from viscous liquid propene or butene polymers (commonly referred to as polypropenes and polybutenes which are commercially available materials) having a number average molecular weight of about 250–500, by sulfonation with gaseous sulfur trioxide, purification and neutralization with ammonia. Illustrative of the preparation of the ammonium alkenyl sulfonates is the following example:

Liquid polybutene (butene polymer having a number average molecular weight of about 340) was introduced into a slot-type falling film reactor of the type described in U.S. Pat. No. 3,328,460 at a rate of 388 pounds per hour. The reactor was twenty-two feet long with a slot dimension of ⅝ inch by 24 inches. The film temperature in the reactor was 80°–122°F. Gaseous sulfur trioxide diluted with air at a molar rate of 1.93 mols per mol of polybutene, was introduced cocurrently to the film in the reactor at a rate of 170 pounds per hour and air rate of 900 cubic feet per minute at 18 psig. Liquid residence time was about 125 to 150 seconds in the reactor. The crude acid mix from the reactor had a total activity of about 72 weight percent, contained about 46 weight percent sulfonic acid, about 7 weight percent hexane-insoluble sludge, and about 19 weight percent sultone.

The crude acid mix was diluted with an equal volume of hexane and 10 weight percent water. The aqueous mixture was held with agitation at 130°–140°F for one hour in a holding-settling tank. After a two-hour settling period, the aqueous phase was drawn off and the hexane-acid phase transferred to a reactor for neutralization.

Neutralization of the sulfonic acid-sulfonate mixture in hexane was effected by introducing anhydrous ammonia into the mixture at a rate of two cubic feet per hour per gallon while maintaining temperature of the mixture below 150°F until a color change of from black to amber is noted which indicated neutralization of the sulfonic acid. At that point the ammonia rate was reduced to 0.5 cubic feet per hour per gallon and the temperature of the mixture raised to drive off hexane and water to a temperature of 310°F. The mixture was held at 310°F with continued introduction of ammonia for 2 hours to reduce the sultone content at which time the treatment was terminated. The neutralized product containing 64.6 weight percent ammonium alkenyl sulfonate and 2.8 weight percent sultone was a crystal clear liquid that did not require filtration.

The term "activity" as used herein refers to the percent of acidic polar material present in the crude sulfonation reaction and neutralized products by silica gel chromotography. A two gram sample is diluted with 20 ml. hexane and deposited at room temperature on a 40 gram silica gel column having a 0.75 inch diameter. The unreacted polymer is eluted from the column with 250 ml of hexane and weight obtained after evaporation of hexane. Sample weight minus weight of polymer yields total activity in sample. Sultone content is obtained by elution with 250 ml. of chloroform. Sulfonate content is total activity minus sultone.

DESCRIPTION OF THE PREFERRED EMBODIMENT

An anhydrous mixture of 356 gram (2.3 mol) barium oxide, 600 ml. methanol and 600 gram light catalytic cycle oil was carbonated by blowing the mixture with carbon dioxide at a rate of 1.6 cubic foot per hour (1.88 mol per hour) while maintaining the temperature of the mixture at about 120°–130°F for 65 minutes. The amount of carbon dioxide that was introduced was sufficient to carbonate about 2.08 mol of the barium oxide in the mixture. To the carbonated mixture, containing 0.25 mol unreacted barium oxide, was added 325 gram (0.5 mol) of ammonium polybutenyl sulfonate, wherein the polybutenyl moiety had a number average molecular weight of about 340, diluted in 187 gram light catalytic cycle oil. The mixture was heated to 165°F and about 70% of the methanol removed from the mixture. Then 44 ml. (2.4 mol, about 1.1 mol per mol of barium) water was gradually added to the mixture and the mixture heated with stirring at a temperature of 180°–190°F until the temperature of the mixture dropped which was about 10 minutes. The product mixture was then heated to 270°–300°F to remove methanol and water, and then filtered. The product containing the light catalytic cycle oil had a total base number (mg KOH/gram) of 187 and contained 21.8% barium and 20% barium sulfonate. Utilization of barium was about 99%.

The over-based oil-soluble barium sulfonates described herein are useful as additives for lubricants and as smoke inhibitors in diesel fuels.

I claim:

1. The process for preparing over-based oil-soluble barium alkenyl sulfonates comprising: heating a mixture comprising (a) ammonium alkenyl sulfonate wherein the alkenyl moiety is a propene or butene polymer having a number average molecular weight of about 250–500, (b) an amount of an anhydrous precarbonated mixture of barium oxide in methanol sufficient to provide about 1–6 mols of barium per mol of said sulfonate, (c) a stoichiometric amount of barium oxide to convert said sulfonate to barium sulfonate, and (d) about 0.5–1.5 mols water per mol of barium in mixture at a temperature of about 160°–190°F for a period of time sufficient to convert said ammonium sulfonate to barium sulfonate; and removing methanol, water and unreacted material from the mixture whereby said over-based barium alkenyl sulfonates are obtained.

2. The process of claim 1 wherein said polymer is a butene polymer.

3. The process of claim 2 wherein said polymer has a number average molecular weight of about 300–400.

* * * * *